US005343574A

United States Patent [19]

Butte

[11] Patent Number: 5,343,574

[45] Date of Patent: Sep. 6, 1994

[54] MOVABLE WASHSTAND WITH ARTICULATED UPPER TRAY

[76] Inventor: Patrick Butte, 20 rue Professeur Pattel, 69009 Lyon, France

[21] Appl. No.: 941,442

[22] PCT Filed: Feb. 18, 1992

[86] PCT No.: PCT/FR92/00155

§ 371 Date: Oct. 22, 1992

§ 102(e) Date: Oct. 22, 1992

[87] PCT Pub. No.: WO92/14392

PCT Pub. Date: Sep. 3, 1992

[30] Foreign Application Priority Data

Feb. 26, 1991 [FR] France ..... 91 02518

[51] Int. Cl.[5] ..... A45D 19/04

[52] U.S. Cl. ..... 4/516

[58] Field of Search ..... 4/515–523, 4/644

[56] References Cited

U.S. PATENT DOCUMENTS

| | | | |
|---|---|---|---|
| 1,789,899 | 1/1931 | Guinness | 4/644 |
| 2,514,540 | 7/1950 | Freund et al. | 4/644 |
| 3,594,830 | 7/1971 | Clifton | 4/516 |
| 4,183,559 | 1/1980 | Stafford et al. | 285/190 |
| 4,660,233 | 4/1987 | Beaver | 4/516 |

FOREIGN PATENT DOCUMENTS

| | | | |
|---|---|---|---|
| 1457399 | 4/1969 | Fed. Rep. of Germany | 4/518 |
| 1904073 | 8/1970 | Fed. Rep. of Germany | 4/644 |
| 3903516 | 3/1990 | Fed. Rep. of Germany | 4/644 |
| 906579 | 3/1944 | France . | |
| 2430210 | 7/1978 | France . | |
| 1164438 | 9/1969 | United Kingdom . | |

*Primary Examiner*—Charles E. Phillips
*Attorney, Agent, or Firm*—Harris Beach & Wilcox

[57] ABSTRACT

A mobile washstand comprises a trolley on wheels, an upper stand integral with the trolley, comprising in the proximity of one of its ends a hollow vessel and a tap associated therewith, a device for supplying water to the tap, and a device for discharging the effluent from the vessel into a storage container. The upper stand is articulated into a storage container. The upper stand is articulated on the trolley about a vertical axis located in the proximity of the stand end opposite the vessel.

7 Claims, 7 Drawing Sheets

MOVABLE WASHSTAND WITH ARTICULATED UPPER TRAY

BACKGROUND OF THE INVENTION

1. Field of the Invention

The invention relates to a new type of movable washstand, more particularly intended for the hospital environment, but nonetheless not limited to this single application.

2. Description of the Prior Art

Certain patients, or even simply elderly people, are often so frail that it is not possible for them to get up to wash or to simply freshen up. Now, hygiene and comfort of these people nevertheless make it necessary for them to freshen up, even if only once a day. In order to do this, it was firstly proposed to use two bowls which would be placed on the board which also served as a support for meal trays. Aside from the impractical aspect of this method it does not, moreover, fulfill the most elementary conditions of hygiene, required for certain pathologies, especially contagious ones. Moreover, the minimum comfort conditions are not met.

Movable washstands were then proposed, for example washstands on castors, comprising a sink communicating via an evacuation pipe with a waste-water storage tank. The water necessary for washing or for freshening up is generally contained in a basin or a bowl simply placed on the washstand. Once again, the conditions of hygiene, although better respected than in the preceding case, still remain insufficient for a great number of applications. Moreover, the patient is obliged to bend to one side or the other of his bed in order to be able to reach the washstand, and thus to freshen up. Finally, this type of movable washstand requires a lot of manipulation for the nursing staff and thus proves to be impractical.

SUMMARY OF THE INVENTION

The invention aims to overcome all these various drawbacks. It proposes a movable washstand, especially intended for the hospital field or people hospitalized at home, intended to allow a bed-ridden person to freshen up under hygienic and comfortable conditions compatible with the conditions required especially in the hospital environment.

This movable washstand comprises:

- a trolley mounted on castors,
- an upper tray, securely fastened to the trolley, comprising in the vicinity of one of its ends a hollow trough and a tap associated with this trough,
- a device for supplying the tap with clean water,
- a device for evacuating waste water from the trough to a waste-water storage tank.

This movable washstand is characterized in that the upper tray is articulated on the trolley about a vertical axis situated in the vicinity of the end of the tray opposite the trough.

In other words, the invention consists in providing a movable washstand with an upper tray which can move rotationally in a horizontal plane, in order to allow the trough to be placed facing the bed-ridden patient, regardless of where the washstand is placed at the side of the bed. This facility, which allows the comfort of the patient to be considerably enhanced runs into a certain number of technical difficulties which are resolved by the movable washstand in accordance with the invention.

Advantageously, in practice:

- the articulation is produced by means of a circular turntable called an articulation turntable, in the shape of a ring comprising a ball bearing, coaxial with the vertical articulation axis, and fixed on the upper face of the trolley, at the interface of the upper tray and of the trolley, to allow a 360 degrees rotation of the tray;
- the water supply is autonomous and comprises:
  - a water tank situated in the trolley,
  - a pump supplied electrically by means of accumulators, of batteries or of cells which are rechargeable, pumping from the water reserve and supplying an annular duct defined by two circular half-rings respectively a lower one and an upper one, situated coaxially with the articulation axis of the upper tray on the trolley, and situated in a plane slightly lower than the articulation turntable, the upper half-ring being connected by at least one pipe to the tap, and the lower half-ring being connected by at least a pipe to the pump;
- the interface separating the two half-rings is covered with polytetrafluoroethylene, and sealing of the annular duct is provided by two concentric neoprene annular seals, situated in grooves made for this purpose on the facing faces of said half-rings;
- the bottom of the trough is slightly inclined in the direction of the center of the tray, and the trough is closed off by a bung, the former communicating with an evacuation pipe for waste water ending in the waste-water storage tank situated under the half-rings defining the annular duct, after passing through the center of said duct;
- the waste-water storage tank comprises a floating bell coaxial with the axis of revolution of said tank, and having at its center a protuberance of revolution directed upward;
- the lower end of the evacuation pipe for waste water comprises an annular vent, securely fastened to the outer periphery of said pipe, and extending upward, intended to interact with the inner wall of the neck of the waste-water storage tank;
- the trolley comprises four doors, articulated in the region of the middle of each of its lateral faces, allowing access to the waste-water storage tank, and to the clean-water tank, with a view to their respective draining and filling; moreover, the trolley comprises on its upper face an articulated cover which can be folded down, capable of being opened when the upper tray is offset and not folded.

BRIEF DESCRIPTION OF THE DRAWINGS

The manner in which the invention can be produced and the advantages which result therefrom will better emerge from the embodiment example which follows, given by way of an indicative and non-limiting example supporting the appended figures.

And finally

DESCRIPTION OF THE PREFERRED EMBODIMENT

Figure 1:
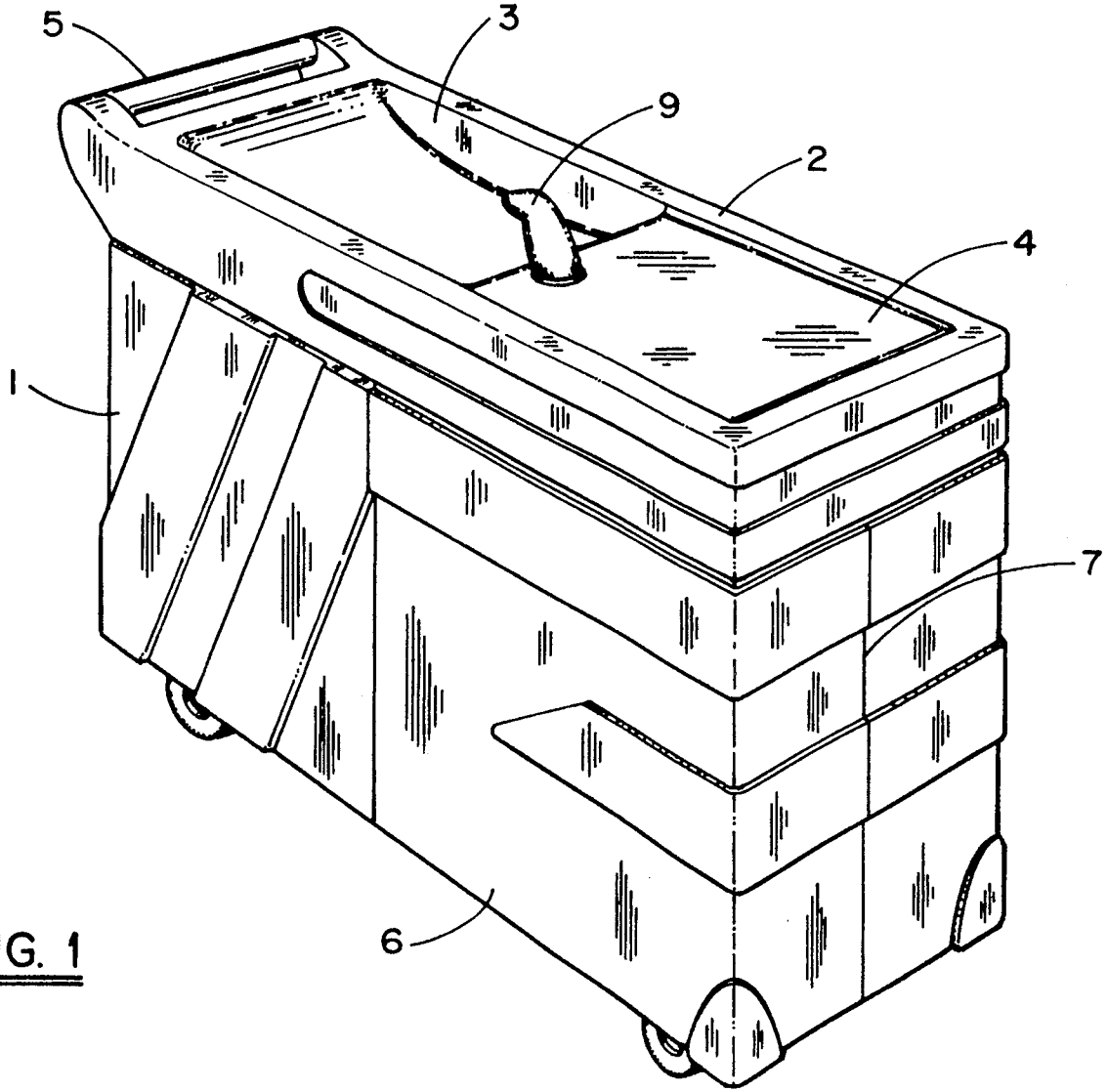
FIG. 1 is a diagrammatic view in perspective of the movable washstand in accordance with the invention.
Figure 2:
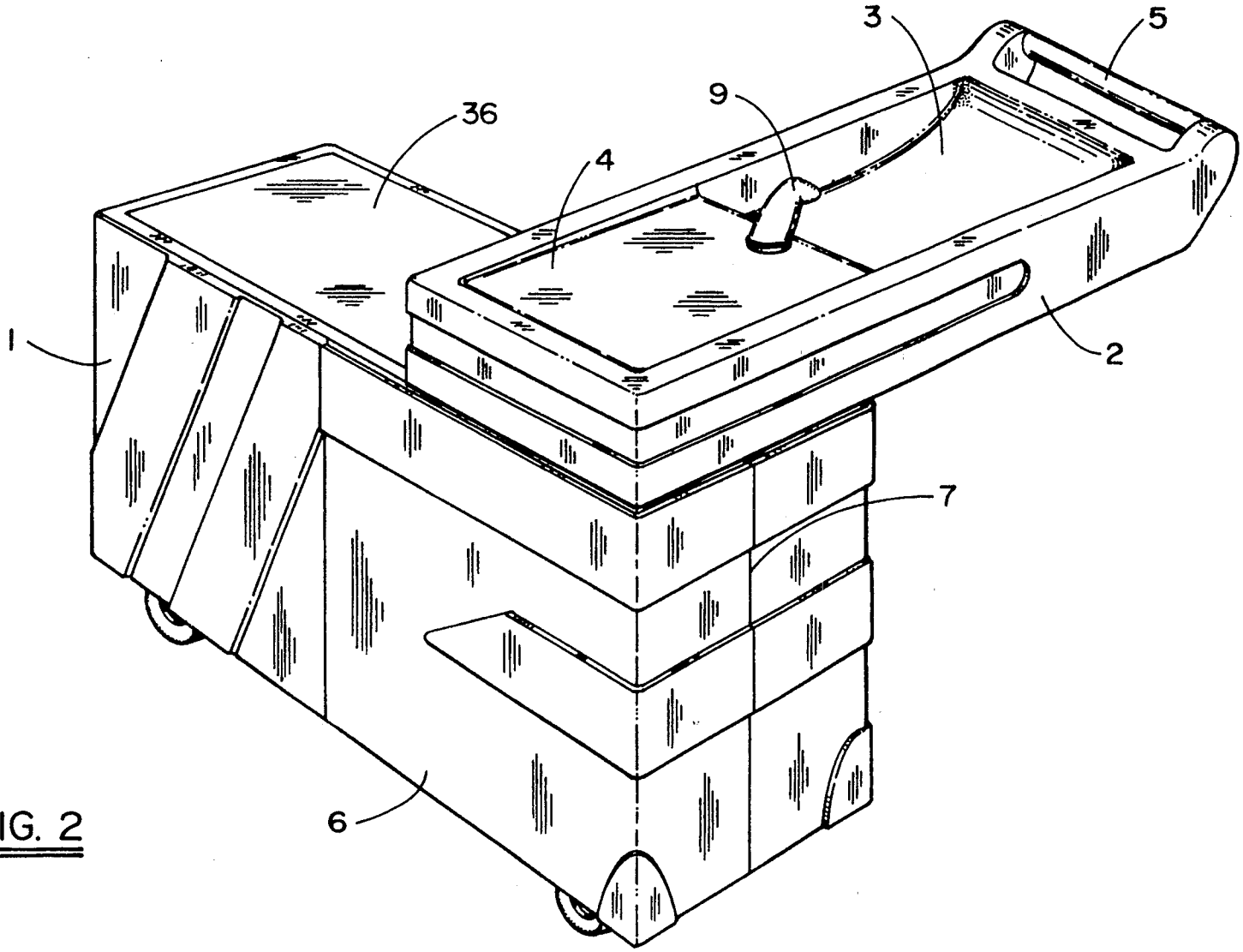
FIG. 2 is a diagrammatic view in perspective of the movable washstand, the upper tray being shown in the offset position with respect to the rest of the trolley.
Figure 3:
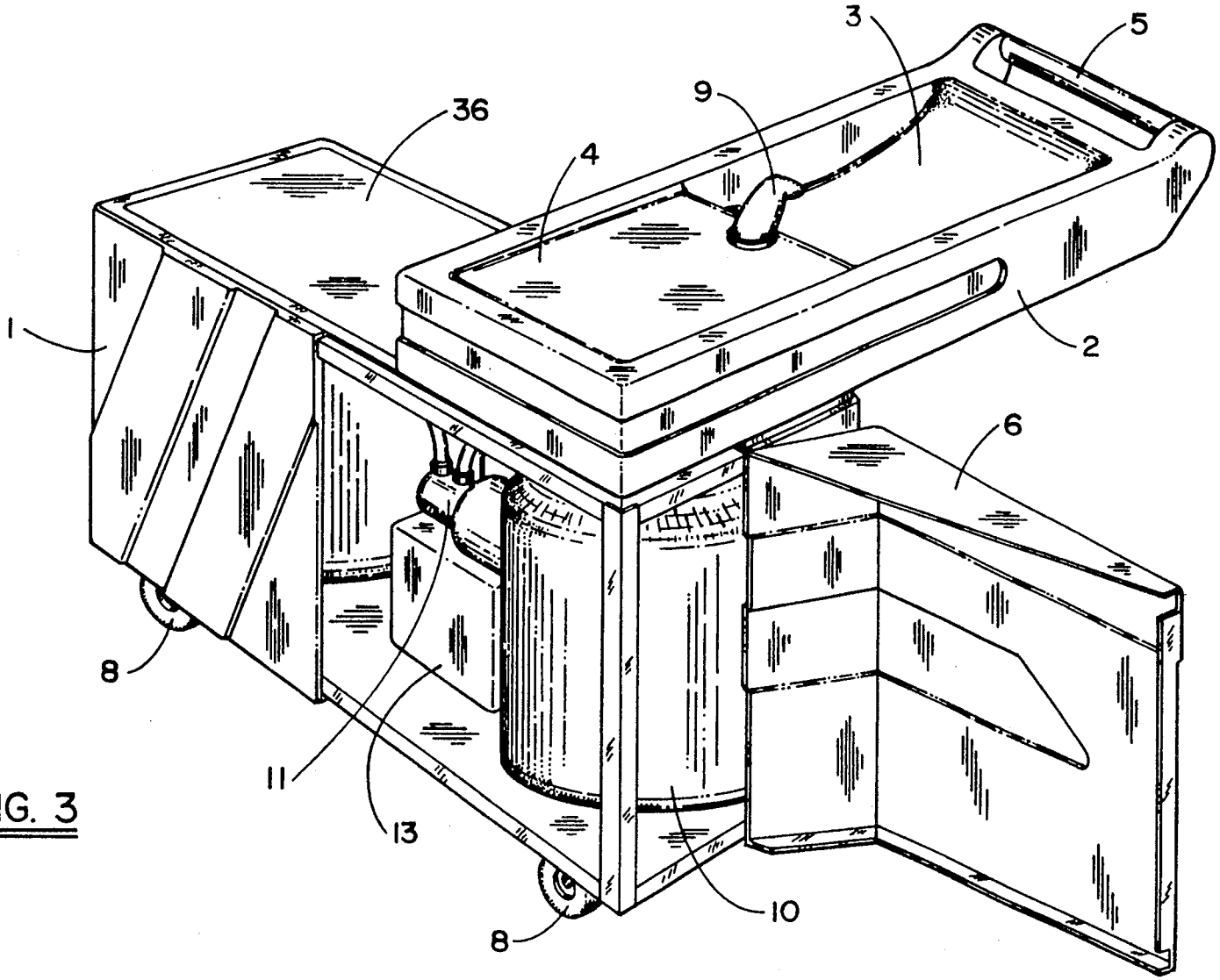
FIG. 3 is a diagrammatic view in perspective similar to FIG. 2 with the front panel open.
Figure 4:
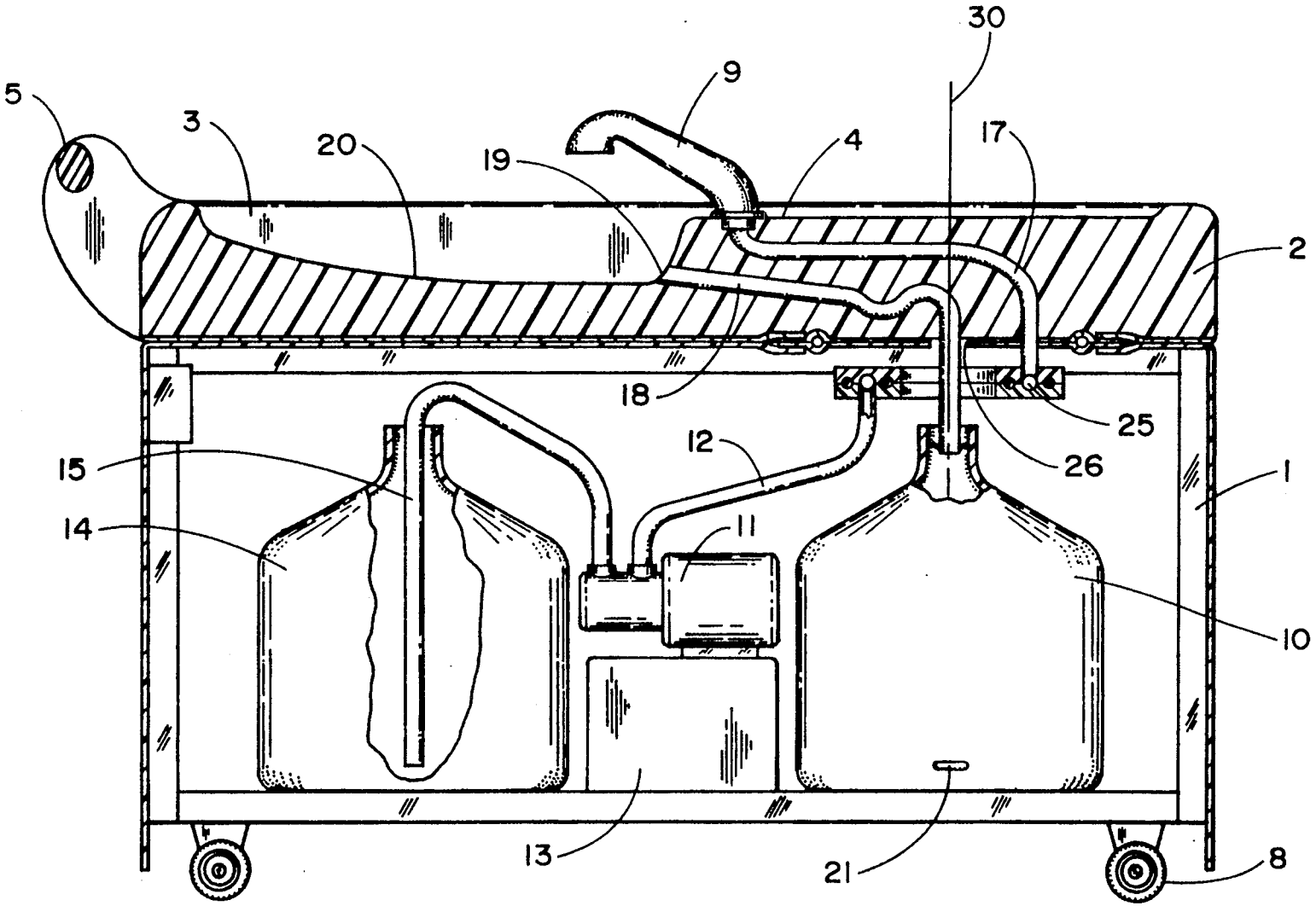
FIG. 4 is a diagrammatic longitudinal section of the movable washstand in accordance with the invention.
Figure 5:
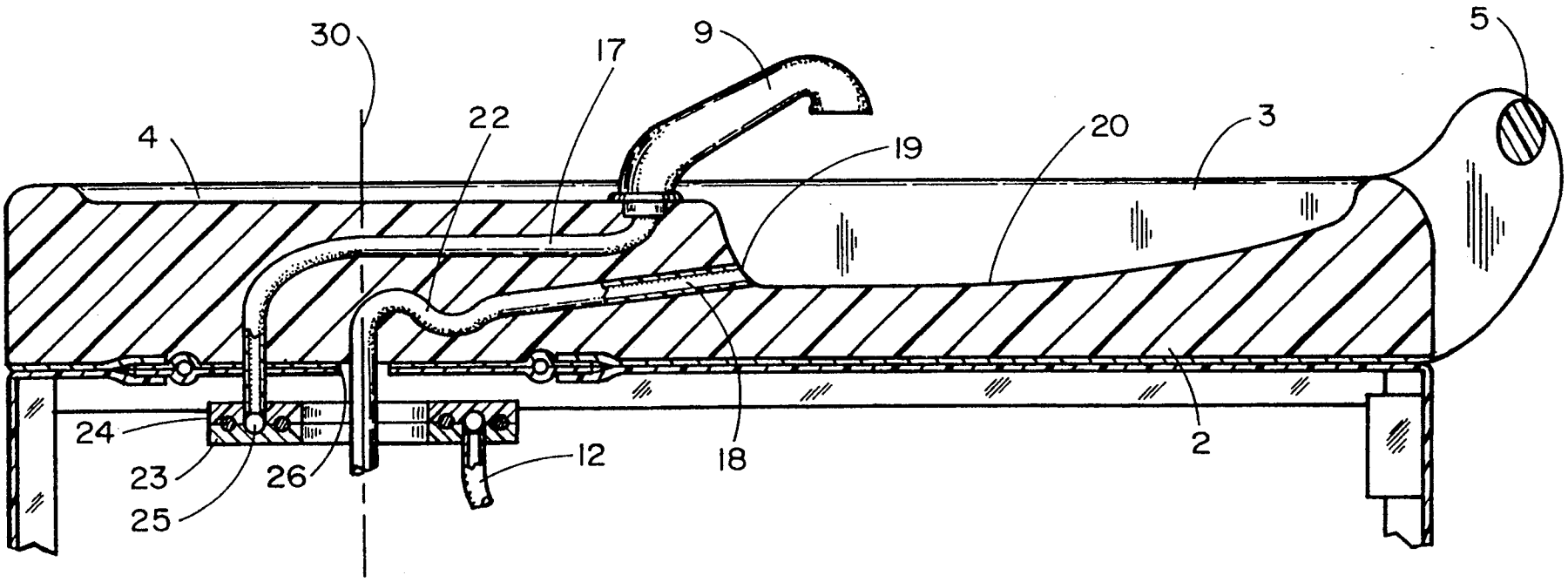
FIG. 5 is a detailed view of the upper tray of the washstand in accordance with the invention.
Figure 6:
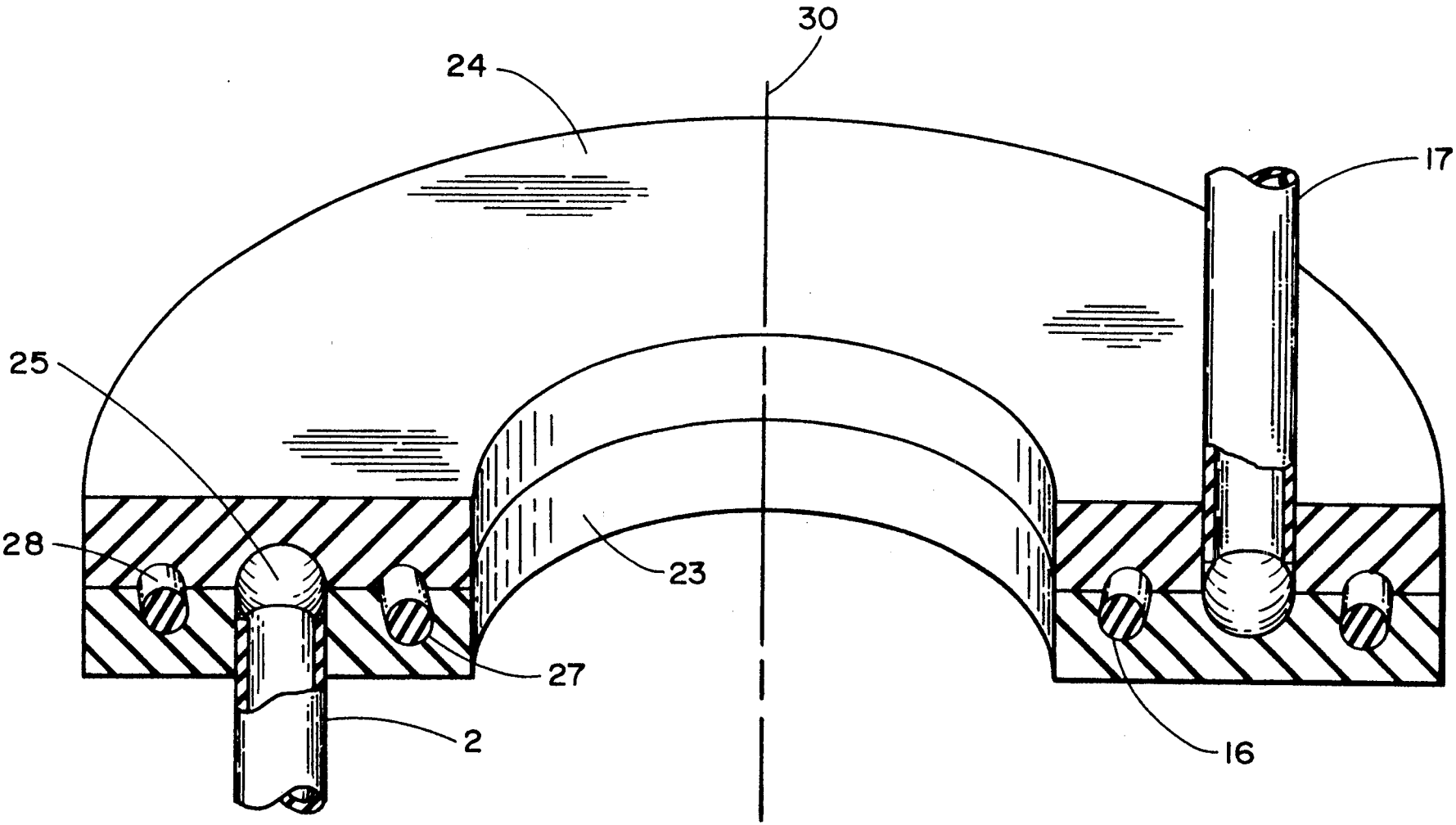
FIG. 6 is a diagrammatic expanded view of the annular duct of the water supply circuit of the movable washstand in accordance with the invention.

According to the invention and as can be seen in FIG. 1, the movable washstand in the folded position is in the shape of a parallelepiped. It is fundamentally composed of a trolley (1). It is produced from an approved sanitary material, and typically from a thermo-formed plastic which is strong and compatible with the conditions of use. The thermoformed plastic assembly is mounted on an anti-corrosion treated tubular framework, for example made of stainless steel or electrically galvanized steel. It comprises four castors (8), optionally adjustable in height and intended to allow its movement in a convenient manner.

According to an advantageous characteristic of the invention, the trolley (1) comprises a front door (6), articulated in the region of a hinge (7), situated on the lateral face (7) of said trolley (1), contiguous with the articulation axis of the upper tray (2). The opening of this door (6) gives access to the inside of the trolley (1), and especially to the tank (10), intended for collecting waste water, as will be described in more detail later. Moreover, the trolley comprises three other doors, articulated in a similar manner, and intended to allow access to the various elements and components contained in the trolley. Finally, it comprises, on its upper face, a cover (36) for accessing the inside from above. This cover is articulated in the region of a hinge not shown, and is only accessible when the upper tray (2), described in detail hereinafter, is retracted out of the plane of the trolley.

According to the fundamental characteristic of the invention, the movable washstand comprises an upper tray (2), mounted pivotably with respect to the trolley (1). This upper tray (2) essentially comprises a hollow trough (3), intended to receive water, and situated in the vicinity of one of the ends of the tray, the adjacent end of said trough being extended by a handle (5). The other end comprises a board (4), for example intended to receive the wash kit and other items for freshening up.

The upper tray (2) can also be produced by thermoforming and this is carried out in a completely conventional manner.

In order to be able to pivot about the vertical axis (30), situated in the vicinity of one of the ends of the trolley, the upper tray (2) is securely fastened to the trolley (1) by the intermediary of a turntable (26) with a ballbearing arrangement, well-known for this function. This turntable (26) is fixed on cross members securely fastened to the framework of the trolley. In fact, this turntable is designed such that it allows the overhang produced by the free end of the tray (2) with respect to the rest of the trolley (1). Moreover, and as will be described later, this overhang is compensated for by the presence of tanks situated inside the trolley (1), these tanks acting as counterweights.

As already explained, the upper tray (2) comprises a trough (3), whose bottom (20) is slightly inclined in the direction of the center of the tray up to the region of a bung (19), capable of closing off, and this in a known manner, the trough. This bung (19) is extended by an evacuation pipe (18), for example produced from polyvinyl chloride (PVC), terminating by the intermediary of a siphon (22) at the waste-water storage tank (10).

Moreover, the upper tray (2) comprises, in the region of the trough (3), a tap (9), controlled by a cell or controlled by hand, supplied with water via a pipe (17) from an annular duct described in more detail hereinafter. The two pipes are advantageously molded when the upper tray is produced. More specifically, the plastic, typically polyurethane, is expanded after installing the various pipes and other fittings, and after having attached a plate acting as a lower face (33) on the lateral flanks of the tray (2). For example, polybutylene is chosen for the clean-water supply pipe (17). In this way, a hygienic and soundproof upper tray (2), particularly appreciated in the hospital environment, is obtained.

The clean-water supply, which is, if necessary, microfiltered, or even sterilized after exposure to ultraviolet radiation, is made from a tank (14), contained in the trolley, of a capacity of 80 liters, and for example produced from rotationally molded polyethylene. This tank is situated under the trough (3), when the upper tray (2) is in the folded position above the trolley. A pipe (15) descends into the tank and is intended to provide the transfer of water towards the annular duct (25) by suction by means of a low-voltage electric pump (11). The latter is electrically supplied by means of accumulators (13) or of cells or batteries which are rechargeable, or even directly from the electric mains supply (220 volts).

The pump (11) thus causes, under electronic slaving activated directly by the tap, the transfer of water from the pipe (15) to the pipe (12) the latter routing it to the region of the annular duct (25). The latter is typically composed of two circular half-rings, respectively an upper one (24) and a lower one (23), defining the annular duct proper (25). The sealing of the annular duct (25) is provided by the presence of two neoprene seals (27) and (28) coaxial with said half-rings and concentric. These two seals are received in two grooves of suitable dimensions, made respectively in the two half-rings. Moreover, the interface (16) for interaction between the two half-rings is covered with polytetrafluoroethylene, in order to allow quasi-free rotation of one with respect to the other.

The pipe (12) bringing clean water from the pump (11) to the annular duct (25) terminates in the region of the lower half-ring (23) and emerges in the annular duct (25). Correlatively, the pipe (17) bringing clean water from the annular duct (25) to the region of the tap (9) emerges in the annular duct (25) in the region of the upper half-ring (24). In this way, regardless of the rotational movement which may be imparted to the upper tray (2), the problem connected with pipes is systematically overcome, taking into account the free rotation of the upper half-ring (24) with respect to the lower half-ring (23). Thus the possibility of making the upper tray (2) rotate by 360 degrees is obtained, regardless of the direction of rotation.

Moreover, this possibility of rotation is also rendered possible by the fact that the waste-water evacuation pipe (18) emerges in the waste-water storage tank (10) after passing through the siphon (22) and after having traversed the center of said rings (23 and 24) defining the annular duct (25), and as better represented in FIG.

5. In other words, the lower end (29) of the waste-water evacuation pipe (18) is coaxial with, on the one hand, the axis (30) of pivoting of the upper tray (2) and, on the other hand, the center of the turntable (26) with ball-bearing allowing this pivoting, and finally, with the center of the two half-rings (23 and 24) defining the annular duct (25).

The waste-water storage tank is, as already explained, situated in the trolley (1), under the pivoting zone of the upper tray (2). It has a typical capacity of the order of 80 liters. It is also produced from rotationally molded polyethylene. Moreover, it has, at the lower part, a sectional draining valve (21), intended to allow draining of said tank above a floor gulley.

Figure 7:
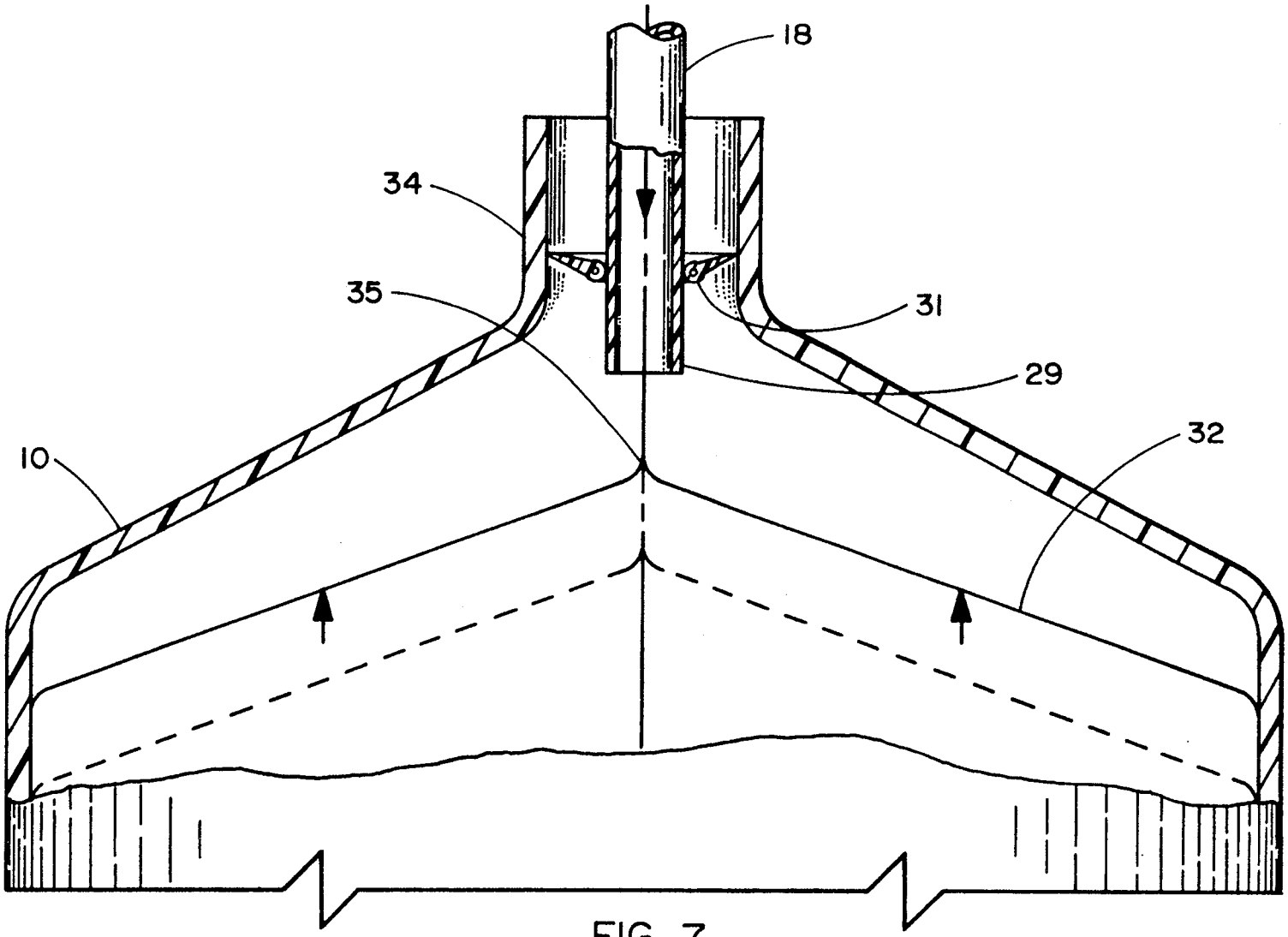
FIG. 7 is a diagrammatic representation of the lower end of the waste-water evacuation pipe.

In order to perfect the hygienic operating conditions of such a movable washstand, it is to be noted, as can further be seen in FIG. 7, that the lower end (29) of the waste-water evacuation pipe (18) can be fitted with an annular vent (31), securely fastened in the region of the outer wall of said end (29), and extending upward. This vent (31) is intended to interact with the inner wall of the neck (34) of the waste-water storage tank (10). In this way, whatever the size of splashes generated by waste water falling into said tank (10), these splashes cannot spread out in the trolley (1) taking account of the presence of this vent. Moreover, this vent, advantageously rigid towards its fixing place at the end (29) of the evacuation pipe (18), is more flexible towards it periphery and allows, due to its structure, air to escape following the arrival of water in the tank (10).

In another embodiment not shown, this vent may be replaced by a rubber disk pierced at its center, force-fitted around the pipe (18), and whose periphery rests on the upper edges of the neck (34) of the waste-water storage tank (10).

In a very advantageous manner, and in order to further limit such risks of splashes, said tank (10) is fitted with a floating bell (32), for example made of plastic such as polyethylene or polypropylene, and having a central protuberance of revolution directed upward in order that water coming from the pipe (18) is broken up on this protuberance without generating significant splashes.

Thus a hermetic waste-water storage tank is obtained, which tank can advantageously be treated against bacteria, by incorporation therein, after each draining, of an antiseptic.

Advantageously, the operation of this movable washstand is managed by a microcontroller, providing the correct operation of the pump, and permanently controlling the levels of the two tanks, respectively for clean water and waste water. Moreover, it controls the charging of the battery, and provides regulation of the transformer integrated with the battery, used during charging periods.

Thus it can be understood that such a movable washstand fulfills the conditions of hygiene and of comfort, as bed-ridden patients would wish them, especially those patients subjected to long periods in hospital, or even hospitalized at home. In fact, a real washstand with running water, which can easily be moved by the presence of castors, is thus made available. Moreover, it considerably simplifies the work of nursing staff, in that manipulations of the patient remains limited. Furthermore, there could conceivably be added a headrest, especially for allowing the hair of the patient to be washed, and also a mirror on one of the edges of the trough (3), in order to improve comfort.

Finally, all the elements intended to come into contact with the water or with a washing liquid are provided with slopes, so that a natural outflow is created, thus avoiding leaving any trace or any foreign body remaining, thus promoting the permanent search for optimum conditions of hygiene.

What is claimed is:

1. A movable washstand, comprising:

a trolley mounted on castors;

an upper tray, securely fastened to the trolley, having a hollow trough near a first end of said tray, and further having a tap associated with said trough;

said upper tray having an articulation with said trolley about a vertical axis that is near a second end of said tray opposite said trough;

an annular turntable, disposed at an interface of said upper tray and said trolley, said turntable having a ball bearing and being coaxial with said vertical axis, and being fixed on an upper face of said trolley;

an annular duct having an upper half-ring which rotates independently of a lower half-ring, said half-rings being positioned coaxially with said vertical axis on said trolley and below said turntable;

means for evacuating waste water from said trough to a waste-water storage tank; and means for supplying clean water to said tap for delivery into said trough connectable to said annular duct such that said upper tray is allowed to pivot 360 degrees with respect to the trolley.

2. A movable washstand according to claim 1, wherein said means for supplying clean water comprises:

a clean water tank disposed in said trolley; and a pump, for pumping water from said clean water tank through a first pipe connected to said lower half-ring of said annular duct through a second pipe connected to said upper half-ring of said annular duct to said tap.

3. A movable washstand according to claim 2, wherein an interface between said upper half-ring and said lower half-ring is covered with polytetrafluoroethylene, and opposing faces of said half-rings have grooves for receiving two concentric annular neoprene seals.

4. A movable washstand according to claim 1, wherein said means for evacuating waste water comprises a bottom surface of said trough inclined in the direction of the center of said upper tray, said trough having a fluid communication with an evacuation pipe for waste water, said fluid communication being closed off by a bung, said evacuation pipe passing through a central aperture in said annular duct and leading to said waste-water storage tank disposed beneath said annular duct.

5. A movable washstand according to claim 4, wherein said waste-water storage tank comprises a floating bell that is coaxial with an axis of revolution of said tank and has at its center an upwardly directed protuberance for breaking up a flow of water from said evacuation pipe.

6. A movable washstand according to claim 4, wherein a lower end of said evacuation pipe comprises an annular vent that is securely fastened to an exterior surface of said pipe and engages an inner wall of said waste-water storage tank.

7. A movable washstand according to claim 4, wherein said trolley comprises four articulated doors, a said articulated door being disposed in a middle region of each lateral face of said trolley for allowing access thereto in order to respectively drain and fill said waste-water storage tank and said clean water tank.

* * * * *